US005601038A

United States Patent [19]

Welch et al.

[11] Patent Number: 5,601,038

[45] Date of Patent: Feb. 11, 1997

[54] SUPPLEMENTAL SHELVING SYSTEM FOR REMOVABLY MOUNTING SHELVES IN A SHELVING STRUCTURE

[75] Inventors: Robert J. Welch, Dallas; Cheryl L. Kniffin, Mountaintop, both of Pa.

[73] Assignee: Metro Industries, Inc., Reno, Nev.

[21] Appl. No.: 301,424

[22] Filed: Sep. 9, 1994

[51] Int. Cl.[6] ..... A47B 57/00

[52] U.S. Cl. ..... 108/193; 211/181; 211/187; 248/243; 108/107; 108/152

[58] Field of Search ..... 211/181, 187, 211/106, 189; 108/193, 106, 107, 149, 152; 248/243

[56] References Cited

U.S. PATENT DOCUMENTS

| | | | |
|---|---|---|---|
| 2,897,978 | 8/1959 | Beckner | 108/107 |
| 3,007,708 | 11/1961 | Ochs | 108/59 X |
| 3,101,148 | 8/1963 | Brown | 108/163 |
| 3,252,434 | 5/1966 | Young, Jr. | 211/181 X |
| 4,157,070 | 6/1979 | Huempfner et al. | 108/107 X |
| 4,558,647 | 12/1985 | Petersen | 211/181 X |
| 4,697,712 | 10/1987 | Valiulis | 248/243 X |

FOREIGN PATENT DOCUMENTS

| | | | |
|---|---|---|---|
| 831395 | 9/1938 | France | 211/106 |

*Primary Examiner*—Peter R. Brown
*Assistant Examiner*—Janet M. Wilkens
*Attorney, Agent, or Firm*—Fitzpatrick, Cella, Harper & Scinto

[57] ABSTRACT

A supplemental shelving system for removably mounting shelves in an existing shelving structure features a pair of supporting grids vertically suspended from a horizontal shelf in the existing shelving structure, at least one removable shelf and S-shaped hooks for supporting the removable shelf from the supporting grids. The supporting grids are formed of a plurality of vertical and horizontal grid rails rigidly secured to each other. The hooks are secured to the horizontal grid rails and support the removable shelf.

10 Claims, 5 Drawing Sheets

SUPPLEMENTAL SHELVING SYSTEM FOR REMOVABLY MOUNTING SHELVES IN A SHELVING STRUCTURE

BACKGROUND OF THE INVENTION

1. Field of the Invention

The present invention relates generally to storage structures, and more particularly to a supplemental shelving system that can be readily incorporated into an existing shelving structure. The supplemental shelving system of the present invention uses a pair of grids vertically suspended from a shelf of the existing shelving structure. A plurality of S-shaped hooks conveniently secure one or more removable shelves to the suspended grids at desired vertical heights. The entire supplemental shelving system can be easily added to the existing shelving structure to provide additional storage space.

2. Description of the Prior Art

Conventional shelving structures typically include a plurality of vertically standing support posts and at least one shelf horizontally supported by the posts. For example, U.S. Pat. Nos. 3,523,508 and No. 3,757,705 disclose a shelving structure formed from four support posts, and one or more horizontal shelves provided with a frustro-conically shaped collar at each corner for receiving one of the support posts. A sleeve is secured to each support post and fits into the frustro-conically shaped collar at each corner of the shelf. The positions of the sleeves on the support posts are vertically adjustable so the height and relative spacing of the horizontal shelves can be chosen when assembling the shelving structure. These adjustable shelving structures are sold and marketed under the trademark SUPER ERECTA SHELF by InterMetro Industries Corporation, of Wilkes-Barre, Penna.

More particularly, FIG. 1 shows in detail a conventional adjustable shelving structure 11 of the type disclosed in U.S. Pat. No. 3,757,705. A formed-wire shelf 13 has a frustro-conically shaped collar 15 at each corner for receiving a support post 17. The wire shelf is defined by a plurality of longitudinally extending wire members 19 and a plurality of transversely extending wire members 21, all welded to one another at their respective intersecting points to form a rigid structure. For additional support, a vertically oriented edge beam 23 is provided around the perimeter of the shelf 13 by a serpentine-like member 25 and a lower support member 27 cooperating with a peripheral top shelf wire 30.

Each support post 17 is generally cylindrical in shape and has a plurality of uniformly spaced annular grooves 29 formed on its outer surface.

To assemble the shelving structure, a sleeve (not shown) is positioned about each support post. Each sleeve is formed with a complementary tapered shape that fits into one of the frustro-conically shaped collars in the shelf, and an inner circumferential bead that can engage any of the annular grooves on a post. A wedging action between the collars and the sleeves produces a radially-inwardly directed force to securely lock the sleeves onto the posts and support the shelf. The vertical height of the shelf can be adjusted by changing the positions of the sleeves on the posts.

When a shelving structure is assembled and put into use, there is often unused vertical space below a lower-most shelf or between two shelves. For example, in a shelving structure having a top shelf, a middle shelf and a bottom shelf, if there are 30 inches of vertical space between the top shelf and the middle shelf and the items stored on the middle shelf are no more than 12 inches in height, there are approximately 18 inches of under-utilized vertical space between the shelves. While a conventional three-shelf structure can be modified to either add one or more shelves and/or adjust the vertical spacing between the existing shelves, this involves at least partially disassembling and then reassembling the shelving structure, a somewhat burdensome and time consuming process, especially when there are items stored on the shelves that must be removed.

A better alternative would be to provide a supplemental shelving system that could be easily added to or removed from the existing shelving structure. Such a supplemental shelving system can provide an easy and convenient way to optimize storage space.

SUMMARY OF THE INVENTION

It is an object of the present invention to provide a supplemental shelving system that can be easily and conveniently added to an existing shelving structure such as that described above.

It is a further object of the present invention to provide a supplemental shelving system that can increase the storage density of an existing shelving structure and more easily optimize storage space.

It is another object of the present invention to provide a supplemental shelving system with removable horizontal shelves that can be supported at adjustable vertical heights.

These and other objects are achieved by the supplemental shelving system of the present invention, which is used in conjunction with an existing shelving structure having at least one horizontally supported shelf. The supplemental shelving system uses a pair of grids, which are vertically supported on the shelves of the existing shelving structure, and one or more removable shelves supported on the grids by a plurality of S-shaped hooks.

In another aspect of the invention, the grids are formed of a plurality of vertical grid rails and a plurality of horizontal grid rails secured to each other to form a rigid structure. At least some of the horizontal grid rails have hooked or curved portions that can embrace the corner posts. Rigid S-shaped hooks can be used to vertically support the grids from one of the existing shelves in the structure.

In still another aspect of the invention, similar rigid S-shaped hooks fit over a horizontal grid rail of the grids and receive a vertical edge of the removable shelf.

In yet another aspect of the invention, the supplemental shelving system comprises a pair of supporting grids that are vertically supported on a horizontal shelf of an existing shelving structure, with each grid having at least one vertical grid member and at least one horizontal grid member, a removable shelf supported by the grids, and connecting means for connecting the removable shelf to the pair of grids.

In still another aspect of the invention, the supplemental shelving system comprises first and second supporting grids that are vertically supported on a horizontal shelf of an existing shelving structure, at least one removable shelf horizontally supported by the first and second supporting grids and a plurality of S-shaped hooks secured to the first and second supporting grids and receiving the removable shelf.

These and other objects, aspects, features and advantages of the present invention will become apparent from the following detailed description of the preferred embodiment taken in conjunction with the drawings.

DETAILED DESCRIPTION OF THE PREFERRED EMBODIMENTS

Figure 6:
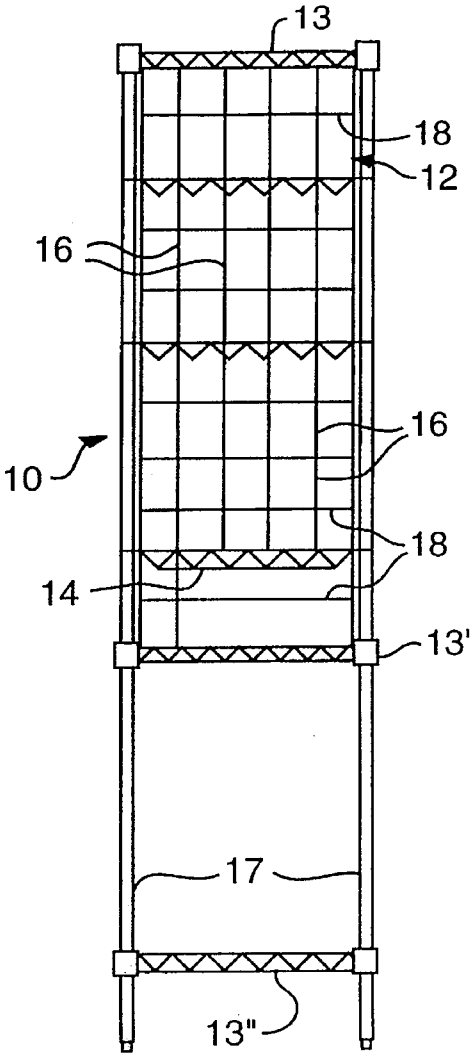
FIG. 6 is a side elevational view of the supplemental shelving system and conventional shelving structure shown in FIG. 2.
Figure 5:
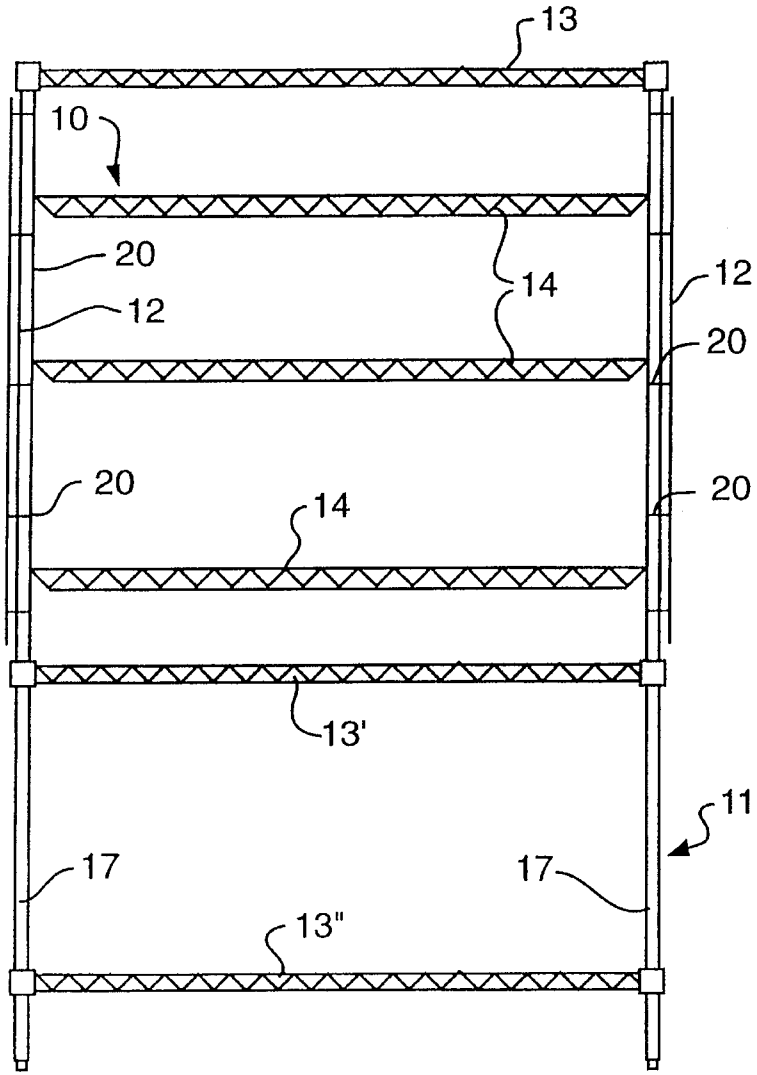
FIG. 5 is a front elevational view of the supplemental shelving system of the subject invention supported on a conventional shelving structure.

The supplemental shelving system for mounting removable shelves in an existing shelving structure, such as that described and illustrated in U.S. Pat. Nos. 3,523,508 and 3,757,705 is shown generally in FIGS. 2A through 6. (The disclosures of these patents are incorporated herein by reference.) In these figures, a conventional shelving structure 11 is equipped with three horizontal shelves, namely, a top shelf 13, a middle shelf 13', and a bottom shelf 13", supported by a plurality of support posts 17 in the manner described above. (Not all elements are shown in all Figures.) The supplemental shelving system of the present invention, generally indicated at 10 in FIGS. 2A, 5 and 6 is mounted on the conventional shelving structure 11 in a manner described in detail below.

The basic components of the supplemental shelving system 10 include a pair of supporting grids 12, one or more removable shelves 14 and a plurality of S-shaped hooks (not shown in FIGS. 5, 6 and 7) for suspending the grids 12 from one or more of the top, middle and bottom shelves 13, 13', 13" and for mounting the removable shelves on the supporting grids. The assembly of these components will be described in greater detail below.

To optimize unused shelving space between, for example, the top and middle shelves, the pair of supporting grids 12 are preferably mounted at opposite ends of the shelf structure 11.

Figure 1:
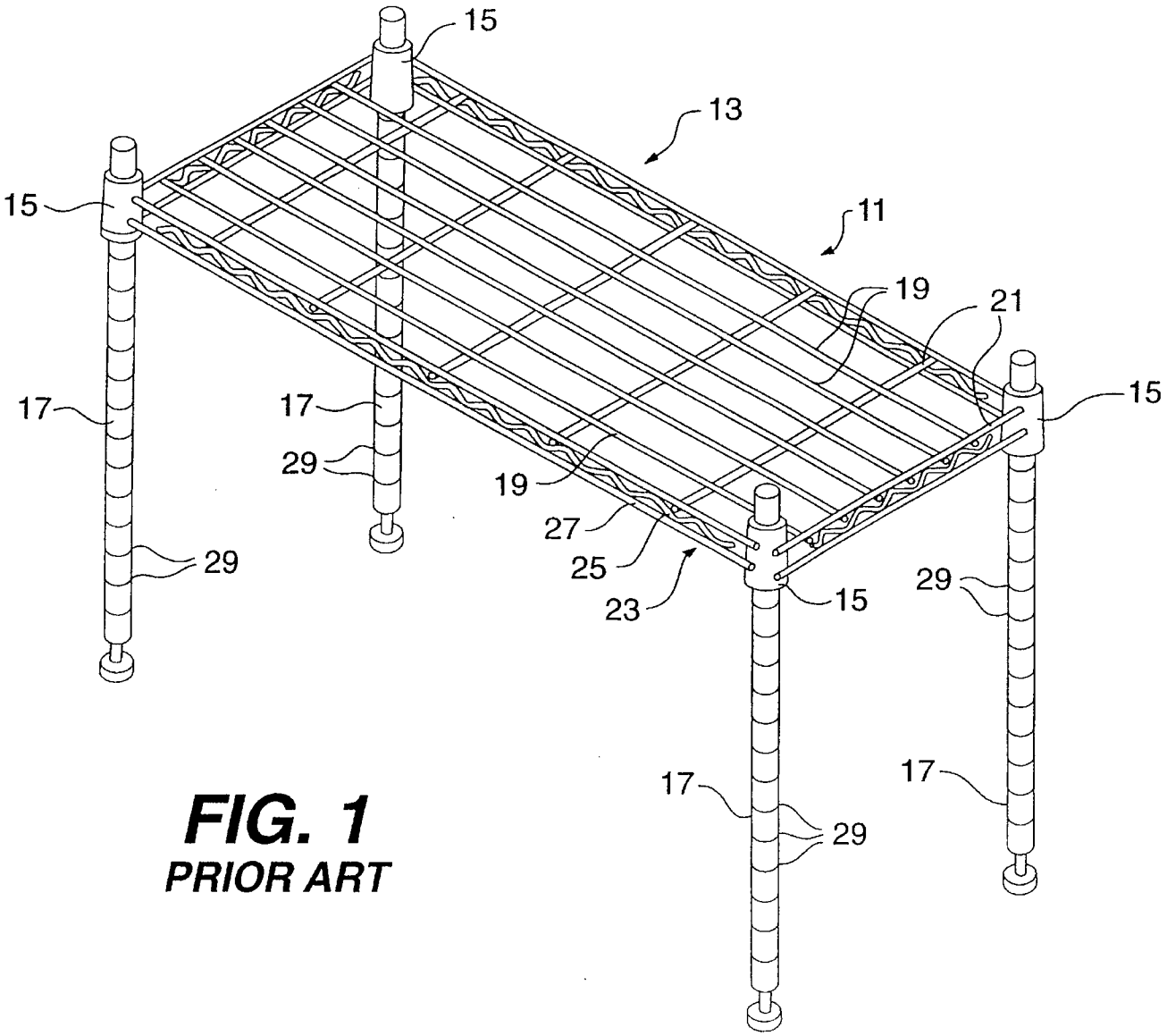
FIG. 1 PRIOR ART
FIG. 1 is a perspective view of a conventional adjustable shelving structure.
Figures 2A, 2B, 2C:
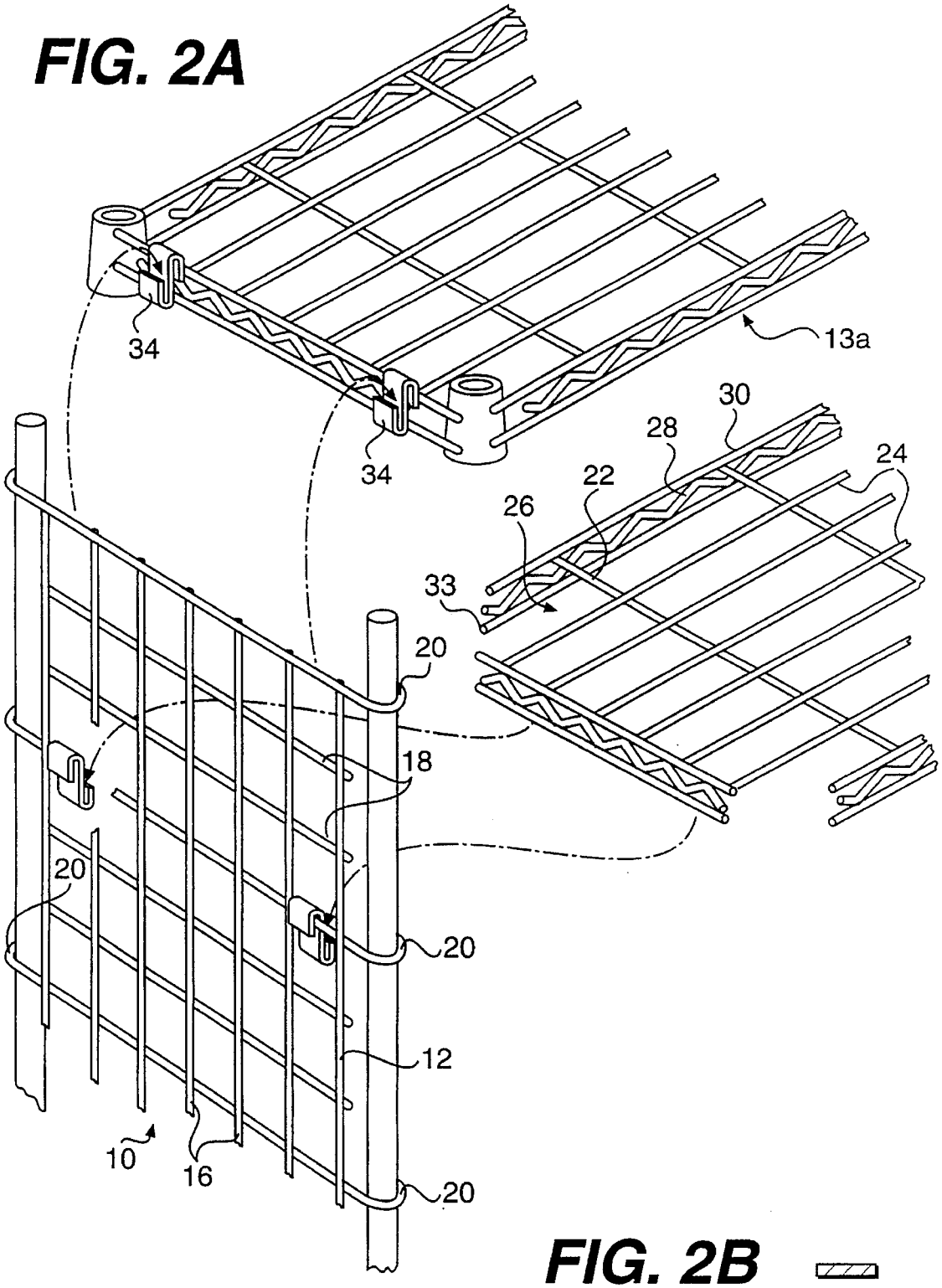
FIG. 2A is a partial perspective view showing one end of the conventional shelving structure of FIG. 1 equipped with components of the supplemental shelving system of the present invention.
FIGS. 2B and 2C show alternative cross-sections of a component of the supplemental shelving system.
Figures 3, 4:
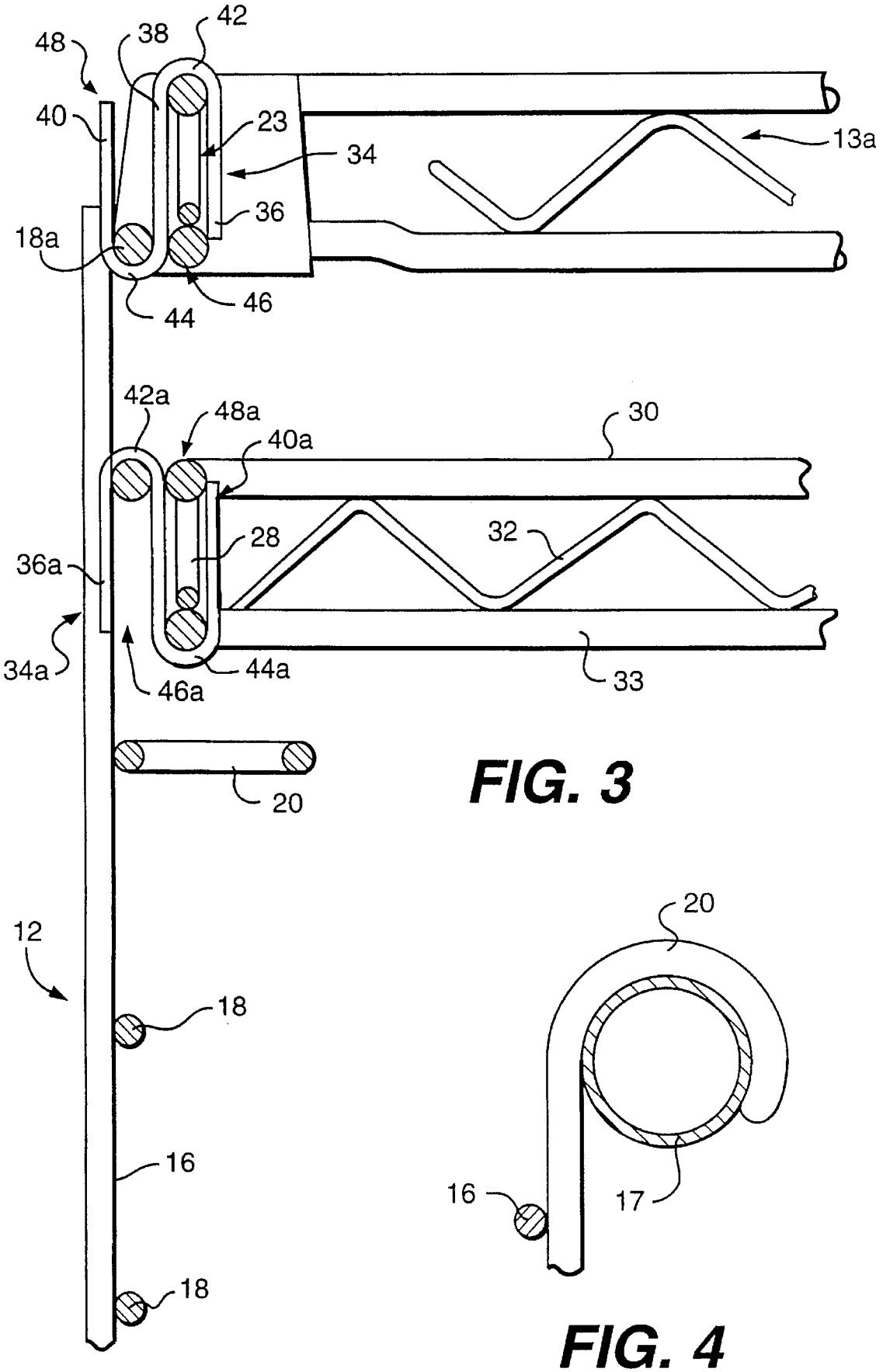
FIG. 3 is a partial side elevational view, shown partly in vertical cross-section, of the components of the conventional structure and supplemental system.
FIG. 4 is a top view, shown partly in horizontal cross-section of one corner post and grid supported on that corner post.

A supporting grid 12 is best shown in FIGS. 2A, 3 and 4 to comprise a plurality of metal vertical members, or grid rails 16, and metal horizontal members, or grid rails 18, secured together at substantially right angles to form a rigid grid configuration. The supporting grid can be formed, for example, by welding the grid rails together at their point of intersection to provide a strong and secure structure. While generally uniform rectangular grid configurations may be defined by the grid rails as shown in the Figures, non-uniform configurations may also be used.

As shown in FIGS. 2A, 3 and 4, the opposing horizontal ends of at least one and preferably more of the horizontal grid rails 18 are bent to form a hooked, or looped, terminal portion 20. Each hooked portion is formed to embrace one corner post 17 by being dropped vertically down after a lower most conventional shelf is mounted on the posts.

After the supporting grids are mounted on the corner posts as described, and intermediate conventional shelves are mounted as desired, a topmost shelf is mounted on them using the frustro-conical shelves in conventional fashion as explained above. The supporting grids 12 are then respectively suspended from opposing end portions of the beam 23 of that topmost shelf 13*a* by S-shaped hooks as shown in FIGS. 2 and 3.

More particularly, each such S-shaped hook 34 is formed as a single rigid piece having three substantially straight legs 36, 38, and 40 and two interconnecting substantially 180° bends or curved portions 42 and 44. One opening 46 defined by the first and second legs 36 and 38 and the first curved portion 42 receives and is supported on one end portion of the beam 23. The topmost horizontal rail 18*a* of the grid 12 may then be received in a second opening 48 of the S-shaped hook defined by the second and third legs 38 and 40 and the second curved portion 44.

Thus it will be appreciated that engagement of the looped portions 20 with the corner posts 17 confines lateral movement of the supporting grids 12 relative to the posts of the shelving structure, while engagement of the topmost grid rail 18*a* with the end beam 23 of the topmost conventional shelf through the S-shaped hooks 34 limits downward vertical movement of the supporting grids.

Figure 8:
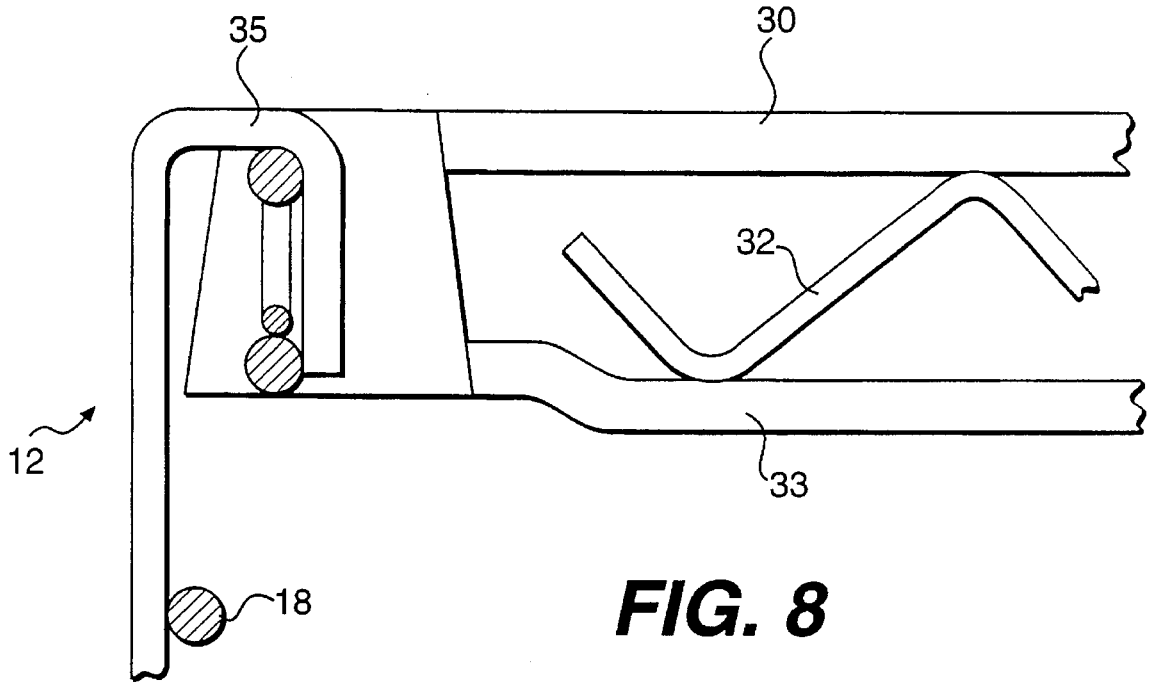
FIG. 8 is a partial side elevational view of a top corner of the shelving system in accordance with a modification of the present invention.
Figure 9:
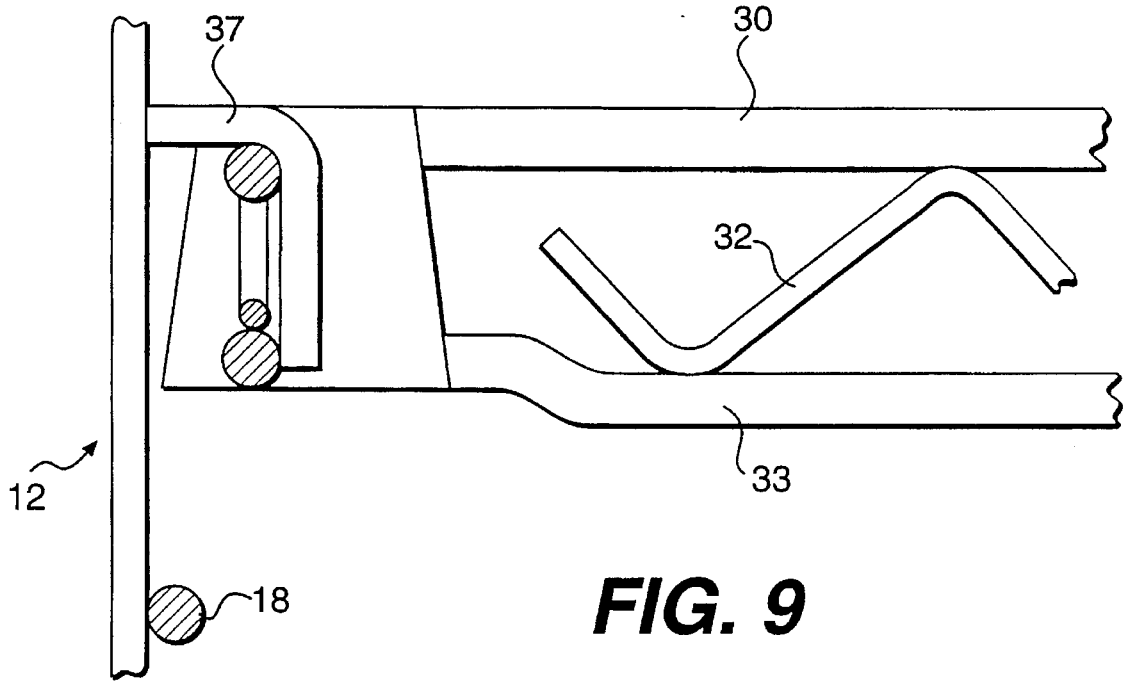
FIG. 9 is a partial side elevational view of a top corner of the shelving system in accordance with another modification of the present invention.

It will be understood that the grids themselves may be formed with suitable, integral hooks, loops, or formed wires engageable with one or more of the fixed shelves, thereby to suspend the grids. In such case, the S-shaped hooks can be eliminated. An example of such a integral inverted U-shaped hook structure 35, engageable with a top-most shelf, is shown in FIG. 8, and an example of such a wire-formed inverted U-shaped offset 37, engageable with a bottom or intermediate conventional shelf, is shown in FIG. 9.

The removable shelves as shown in FIGS. 2A, 3, 5 and 6 are preferably wire-formed in construction with a plurality of longitudinally extending members 22 and a plurality of laterally extending members 24 all welded to one another at their points of intersections to form a rigid base 26. The shelf is framed by an upstanding vertical edge beam 28 having an upper rail member 30 and a serpentine stiffening wire 32 secured between the upper rail member and a bottom rail member 33. The plan of the removable shelf is generally rectangular to approximate the shape of the conventional shelves, but of course the plan of the removable shelf can modified to any desired shape without departing from the scope of the invention.

The removable shelves are usually the same general dimensions as the shelves 13–13' of the conventional shelving structure, e.g., rectangular, to take maximum advantage of the available unused space. The number of removable shelves 14 supported by the supporting grids 12 is arbitrary and depends upon the size and shape of the additional items to be stored.

As best seen in FIGS. 2A and 3, and as noted above, the removable shelves are supported by S-shaped hooks 34*a* similar to those described with reference to support of the grids 12 from the topmost conventional shelf 13*a*. Specifically, each S-shaped hook 34*a* is formed as a single rigid piece having three substantially straight legs 36*a*, 38*a* and 40*a* and two substantially 180° bends or curved portions 42*a* and 44*a*. A first opening 46*a* defined by the first and second straight portions 36*a* and 38*a* and the first curved portion 42*a* receives and is supported by a horizontal grid rail 18 of the supporting grid 12. A second opening 48*a* is defined by the second and third straight portions 38*a* and 40*a* and the second curved portion 44*a* to receive the upstanding edge beam 28 and support the removable shelf 14.

The lateral spacing between the supporting grids and the dimensions of the removable shelves can be varied to optimize the unused space between the existing shelves. Those skilled in the art will recognize that other types of removable shelves besides the wire shelf disclosed above can be used with the supplemental shelving system of the present invention.

As will be appreciated, the curved portions of the S-shaped hooks are designed to complement the cross-sectional shape of the horizontal grid rail 18 and the transversely extending member 24 of the shelf to provide a snug fit. For example, if the horizontal grid rail 18 is made of flat metal stock and has a rectangular cross-section as shown in FIG. 2C (instead of the circular cross-section shown in FIGS. 2B and 3), the first curved portion 42 should have a radius of curvature than complements the rectangular cross-section. Using flat bar stock, such as metal, as the horizontal grid rails is preferred because the rectangular cross-section is better able to prevent rotational movement, or swinging, of the S-shaped hook about the horizontal grid rail. Thus, the S-shaped hook can be securely fitted to the horizontal grid rail and will remain stationary while waiting to receive the removable shelves.

The supporting grids, removable shelves and S-shaped hooks may be formed from any suitable conventional material such as plastic or metal, for example, steel, aluminum or the like. Those skilled in the art will readily appreciate numerous equivalent structures and alternative compositions.

Further, the S-shaped hook 34*a* can be formed from wire or, more preferably, flat bar stock so it has a width, for example, of about an inch, for increased strength and stability. The width of the S-shaped hook can be best seen in FIG. 7.

The openings 46*a* and 48*a*, or slots the S-shaped hooks provide a quick-slot style of shelf assembling, whereby the S-shaped hooks are quickly and easily mounted on the horizontal grid rails and then capable of quickly and easily receiving the removable shelves.

Figure 7:
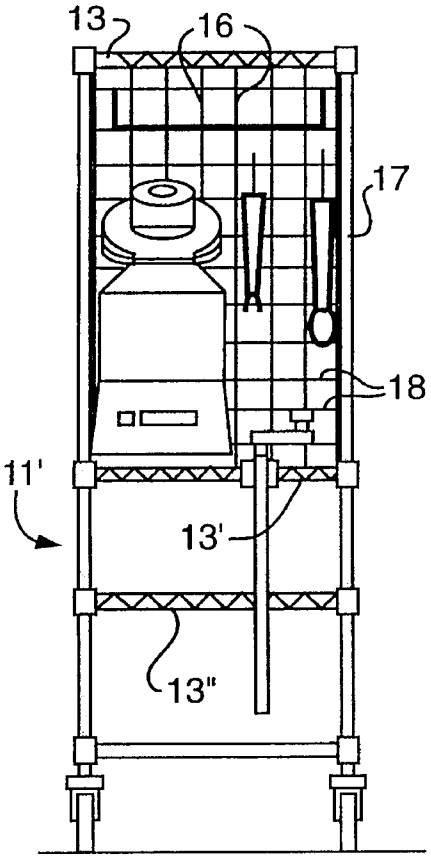
FIG. 7 is a side elevational view of a supporting grid of the present invention vertically suspended from a conventional shelving structure.

It should be noted that, in addition to supporting the removable shelves, each supporting grid can also be used with conventional hooks to hang items, such as kitchen utensils, from the modified conventional shelving structure 11' shown in FIG. 7.

To assemble the supplemental shelving system of the present invention, four corner posts are first erected with a conventional bottom most shelf as described above. A pair of the supporting grids 12 are then mounted by having their looped portions 20 engaged with the corner posts and a conventional topmost shelf 13*a* thereafter is secured to the posts. Of course, each grid can be mounted on two corner posts prior to assembly of the posts with bottom most shelf. The grids are then suspended from the shelves 13*a* of the existing shelving structure as described above using the S-shaped hooks 34. The two supporting grids are spaced laterally from each other a distance substantially equal to the length of the removable shelves to be used. As discussed above, removable shelves approximating the size of the existing shelves are preferred to optimize the storage space, and thus the supporting grids are generally suspended from opposite ends of the existing shelf.

After the supporting grids are mounted, a plurality of S-shaped hooks are placed on the horizontal grid rails at the desired vertical height at which the removable shelf or shelves will be supported. For better stability, it is preferable that at least two or three S-shaped hooks be used to support each end of the removable shelf. When the S-shaped hooks are secured on the supporting grids, the removable shelf can be easily inserted into the quick slot style S-shaped hooks and supported.

By virtue of the ease with which the supporting grids are suspended from an existing shelf, the S-shaped hooks are secured on the horizontal grid rails and the removable shelves are secured to the S-shaped hooks, the supplemental shelving system of the present invention provides a convenient way to optimize storage space in an existing shelving structure. The supplemental shelving system is sturdy enough for use over an indefinite period of time, yet is easy enough to assemble and disassemble to make it worthwhile for temporary or short term usage.

Although a specific embodiment of the present invention has been described above in detail, it will be understood that this description is merely for purposes of illustration. Various modifications of and equivalent structures corresponding to the disclosed aspects of the preferred embodiment in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A supplemental shelving system used with an existing shelving structure having at least one horizontal shelf, said supplemental shelving system comprising:

a pair of removable supporting grids to be vertically supported on the existing shelving structure, each said supporting grid including a plurality of spaced vertical members and a plurality of spaced horizontal members secured to said vertical members at intersecting portions to form a substantially planar rigid structure;

suspending means for suspending each said supporting grid from said existing horizontal shelf;

a removable shelf, and means supporting said removable shelf on said pair of supporting grids, wherein said suspending means comprises an S-shaped hook engable with at least one said horizontal shelf and at least one said horizontal member of said supporting grid, and wherein said existing shelving structure includes at least one support post for supporting at least one said horizontal shelf and said supporting grid includes means for embracing said post.

2. A supplemental shelving system according to claim 1, wherein said vertical members and said horizontal members are formed from bar stock and have a rectangular cross-section.

3. A supplemental shelving system according to claim 1, wherein said removable shelf supporting means comprises at least one S-shaped hook.

4. A supplemental shelving system according to claim 3, wherein each said S-shaped hook is formed from a rigid material shaped to have three substantially parallel straight portions and first and second curved portions.

5. A supplemental shelving system according to claim 4, wherein said first curved portion of said S-shaped hook is received and supported by one of said horizontal members, and said first curved portion is shaped to complement a cross-section of said one horizontal member.

6. A supplemental shelving system according to claim 1, wherein said embracing means comprises a loop formed in at least one of said horizontal members.

7. A supplemental shelving system, comprising:

a pair of removable supporting grids vertically supported on an existing shelving structure having at least one horizontal shelf, with each grid having a plurality of spaced vertical grid rails and a plurality of spaced horizontal grid rails forming a substantially planar rigid structure;

suspending means for suspending each said supporting grid from said existing horizontal shelf;

a removable shelf supported by said supporting grids; and connecting means for connecting said removable shelf to said pair of grids, said connecting means including a first S-shaped hook formed from a rigid material and shaped to have three substantially parallel straight portions and first and second curved portions, wherein said plurality of spaced horizontal grid rails are rigidly secured to said vertical grid rails at intersecting portions, and said suspending means comprises a second S-shaped hook engaging at least one said horizontal shelf and at least one of said horizontal grid rails, and wherein said existing shelving structure includes at least one support post for supporting at least one said horizontal shelf and said supporting grid includes means for embracing said post.

8. A supplemental shelving system according to claim 7, wherein said vertical grid rails and said horizontal grid rails are formed from flat bar stock and have a rectangular cross-section.

9. A supplemental shelving system according to claim 7, wherein said first curved portion of said S-shaped hook comprising said connecting means is received and supported by said horizontal grid rail, and said first curved portion is shaped to complement a cross-section of said horizontal grid rail.

10. A supplemental shelving system according to claim 7, wherein said embracing means comprises a loop formed in at least one of said horizontal grid rails.

* * * * *